US005636383A

United States Patent [19]

Cwiakala

[11] Patent Number: 5,636,383

[45] Date of Patent: Jun. 10, 1997

[54] HEAD MOUNTED APPARATUS FOR SUPPORTING AND RAISING CEILING MATERIALS

[76] Inventor: Thomas W. Cwiakala, 2524 Hermanse Rd., Galway, N.Y. 12074

[21] Appl. No.: 213,049

[22] Filed: Mar. 15, 1994

[51] Int. Cl.[6] ..... A42B 3/06

[52] U.S. Cl. ..... 2/171; 2/209.13; 2/410; 2/422; 224/181

[58] Field of Search ..... 2/171, 171.1, 209.13, 2/410, 422; 224/181; 108/103, 139, 43; 248/349, 633, 634; 384/609

[56] References Cited

U.S. PATENT DOCUMENTS

| | | | |
|---|---|---|---|
| 2,876,051 | 3/1959 | Fox | 384/609 |
| 3,028,059 | 4/1962 | Greenwood | 224/181 |
| 3,365,160 | 1/1968 | Bickner | 248/349 |
| 5,050,245 | 9/1991 | Nearhood | 2/410 |
| 5,255,394 | 10/1993 | Long | 2/410 |

*Primary Examiner*—Diana Biefeld

*Attorney, Agent, or Firm*—Schmeiser, Olsen & Watts

[57] ABSTRACT

A rotatable, head mounted support apparatus for supporting drywall and other ceiling panels during the construction of a ceiling. The rotatable, head mounted support apparatus is preferably secured to the top of a hard hat, and includes rotatable, turntable-type bearing which allows a construction worker to freely swivel his or her head during the installation of a drywall panel.

6 Claims, 2 Drawing Sheets

HEAD MOUNTED APPARATUS FOR SUPPORTING AND RAISING CEILING MATERIALS

FIELD OF THE INVENTION

The present invention relates to a ceiling construction tool and, more particularly, to a rotatable, head mounted support apparatus for comfortably bracing and raising ceiling panels formed of drywall, plywood and the like during the construction of a ceiling. Advantageously, the head mounted apparatus includes a rotatable, turntable-type bearing which allows a construction worker to freely swivel his or her head during the installation of a ceiling panel, thereby providing the construction worker with an unobstructed view of the entire ceiling board as it is raised, positioned and fastened into place. A pair of elastic cords, each slidably received within the housing of the head mounted support apparatus, are provided to adjustably secure the present invention against the top of a hard hat.

BACKGROUND OF THE INVENTION

As known in the art, the most difficult part of drywalling a ceiling occurs at the beginning when the heavy and unwieldy drywall panels must be hoisted up and held in position long enough to drive drywall screws into the ceiling joists. When an assistant is available to help support and position a drywall panel, installation generally proceeds in an efficient and expeditious manner. Unfortunately, when working alone, it is extremely difficult to install a drywall panel on a ceiling without ancillary support. Typically, if a drywall jack or other mechanical lifting device is not available, a construction worker will utilize his head in conjunction with one or both hands to support a drywall panel overhead during installation.

Although the human head has long been successfully utilized to provide a degree of supplemental support during the construction of a drywall ceiling, it is not adapted to comfortably endure the rigors of the installation process. Specifically, as most construction workers can attest, drywall panels, as well as plywood panels and other similar materials, adversely affect the crown of the head, oftentimes resulting in blistering, calluses, abrasions, hair loss and other deleterious injuries. These injuries are further exacerbated when the head is turned relative to the drywall panel to ensure correct positioning, due to the friction developed at the head-panel contact point.

SUMMARY OF THE INVENTION

In order to avoid the disadvantages of the prior art, the present invention provides a rotatable, head mounted support apparatus for supporting drywall and other ceiling panels during the construction of a ceiling. The apparatus, hereinafter referred to as a "head support", is preferably secured to the top of a hard hat or other protective head gear, although it may be easily modified to attach directly about the head of a user. The head support includes a rotatable, turntable-type bearing which allows a construction worker to freely swivel his or her head during the installation of a drywall panel. To prevent any damage of the drywall panel at the head support-drywall interface, the upper, rotatable plate of the turntable-type bearing is covered with a first, resilient, shock absorbing member, preferably formed from a firm density polyurethane foam or similar material.

A pair of laterally disposed elastic cords, each slidably received within a housing mounted to the lower plate of the turntable-type bearing, are utilized to removably and adjustably secure the head support against the top of a hard hat. A second, resilient, shock absorbing member, again preferably formed from a firm density polyurethane foam, is interposed between the hard hat and the bottom of the housing. Advantageously, the first and second shock absorbing members not only protect the head against sudden impacts, but also allow the hard hat to be easily pivoted from side to side and front to back while supporting a panel of drywall.

The housing encloses first and second lateral, peripheral channels, each adapted to slidably receive one of the elastic cords therein. Accordingly, the head support may be adjustably positioned forwardly and backwardly substantially along the upper surface of the hard hat by sliding the housing lengthwise along the elastic cords until the desired orientation is achieved. As the head support is displaced along the elastic cords, each cord slides through its respective channel in the housing.

BRIEF DESCRIPTION OF THE DRAWINGS

These and other features of the present invention will become readily apparent upon reading the following detailed description and upon reference to the drawings in which.

DETAILED DESCRIPTION OF THE INVENTION

Figure 1:
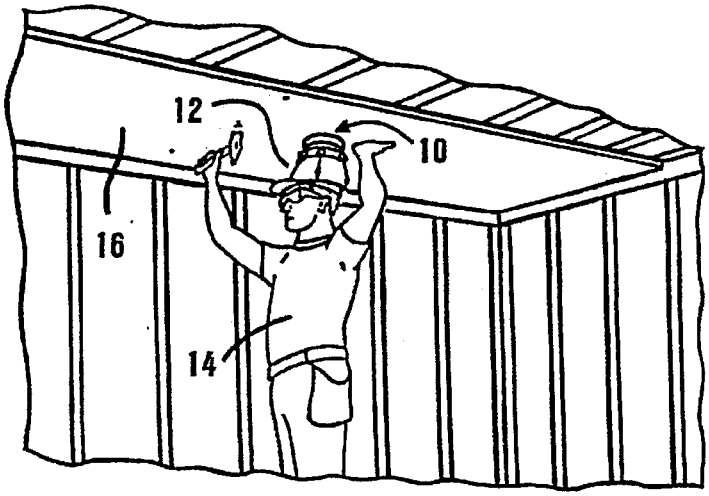
FIG. 1 is a perspective view of a construction worker utilizing the rotatable, head mounted support apparatus of the present invention to support and position a drywall panel during the installation of a ceiling, in accordance with a preferred embodiment.

Referring now specifically to the drawings, there is illustrated a head mounted support apparatus (head support), generally designated as 10, in accordance with a preferred embodiment of the present invention, wherein like reference numerals refer to like components throughout the drawings.

As illustrated in FIG. 1, the head support 10 is adapted to be secured to the top of a conventional hard hat 12 worn by a construction worker 14. The head support 10 is utilized to support a drywall panel 16 as it is raised, positioned and fastened into place during the construction of a ceiling.

The head support 10 incorporates a rotatable, turntable-type bearing 18 having independently rotatable upper and lower plates 20 and 22, respectively. The upper plate 20 of the rotatable, turntable-type bearing 18 is covered with a cylindrically shaped, resilient, shock absorbing member 24 which is glued or otherwise suitably mounted to a support plate 26. A protective covering 28, preferably formed from plastic vinyl or the like, is utilized to protect the upper surface of the shock absorbing member 24 when it is placed against a drywall panel.

The support plate 26 is fixedly secured to the upper plate 20 of the rotatable, turntable-type bearing 18 by inserting a pop rivet (not shown) or other appropriate fastening hardware through each corresponding set of mounting holes 30. Similarly, a housing, comprising an upper housing plate 32 and a lower housing plate 34, is fixedly secured to the lower plate 22 of the rotatable, turntable-type bearing 18 by inserting a pop rivet or the like through each corresponding set of mounting holes 36.

Figure 2:
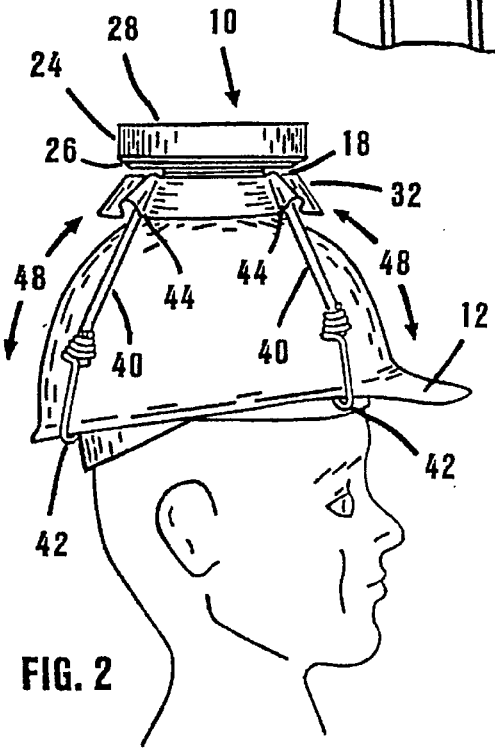
FIG. 2 illustrates the rotatable, head mounted support apparatus of the present invention attached against the top of a hard hat, and the adjustable displacement of the head support thereon via the elastic cords.
Figure 3:
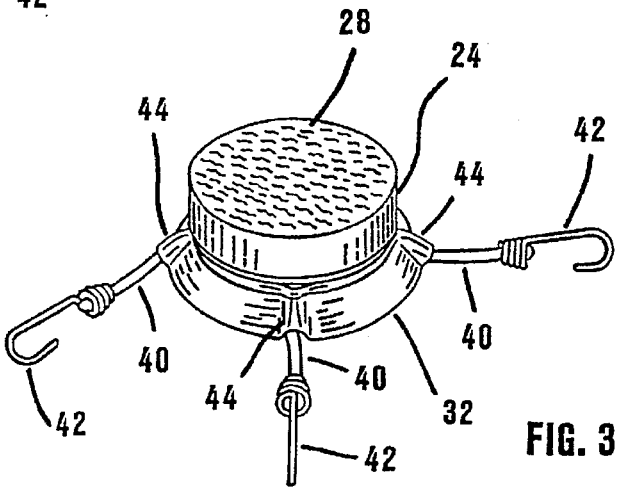
FIG. 3 is a perspective view of the present invention.
Figure 4:
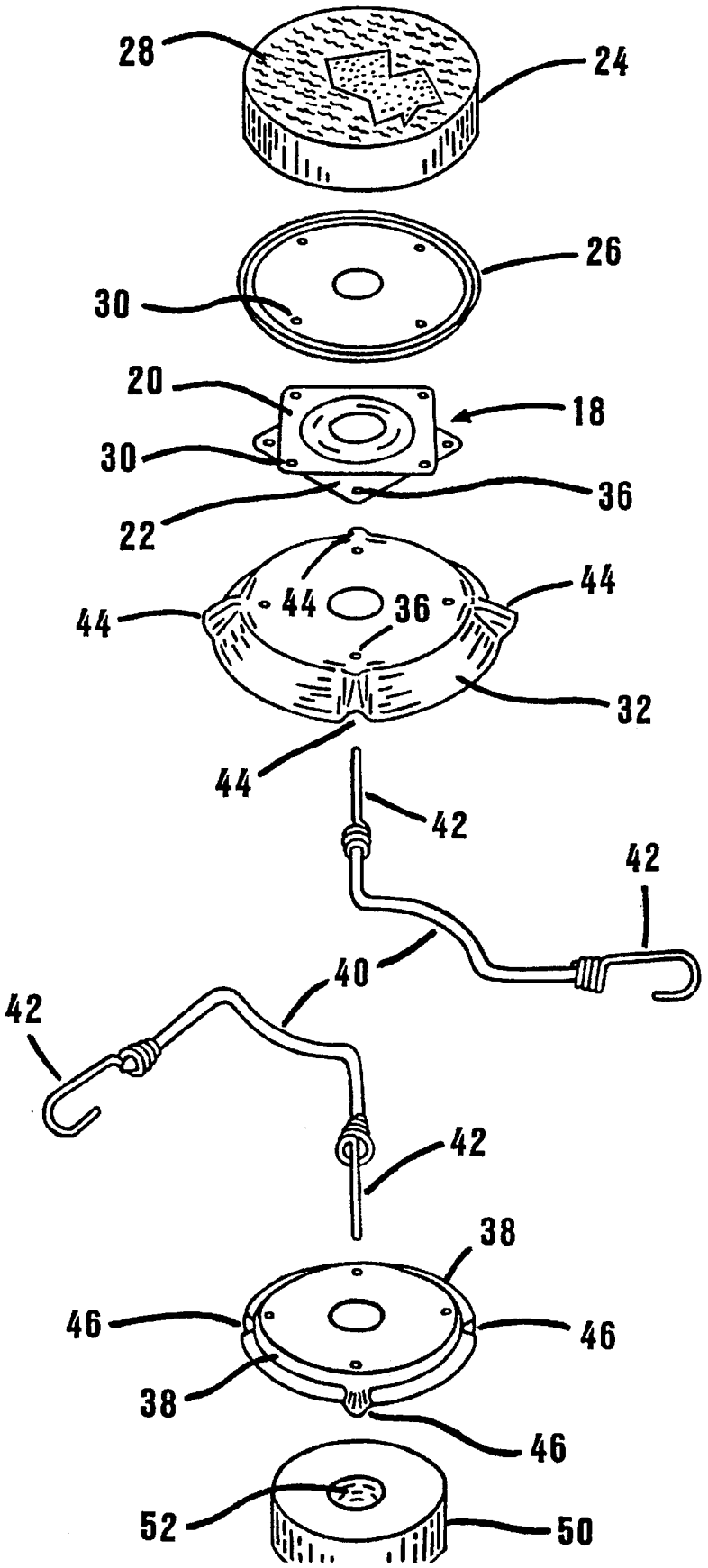
FIG. 4 is an exploded, partially cut-away view of the present invention.

As most clearly depicted in FIG. 4, the lower housing plate 34 includes a pair of opposing, laterally disposed, peripheral channels 38, each adapted to slidably receive an elastic cord 40 therein. A hook 42 is provided on each end of the elastic cords 40 to secure the head support 10 to the top of the hard hat 12 (FIG. 2). When the housing is fully assembled, the opposing end portions of each cord 40 extend out of the housing through a pair of apertures, wherein each aperture is formed by a pair of complementary convex projections 44 and 46 on the upper and lower housing plates 32 and 34, respectively. Since each elastic cord 40 is free to slide within its respective channel 38, the housing may be adjustably positioned forwardly and backwardly along the top of the hard hat 12, as illustrated by the directional arrows 48 in FIG. 2, by sliding the housing along the elastic cords 40 until the desired orientation is realized.

An annular, resilient, shock absorbing member 50 is glued to the bottom surface of the lower housing plate 34 to further absorb sudden impacts. Additionally, due to the presence of the central aperture 52, the annular, shock absorbing member 50 more easily conforms to the curved, upper surface of the hard hat 12. A protective covering (not shown), again preferably formed from plastic vinyl or the like, may be utilized to protect the bottom surface of the shock absorbing member 50.

The foregoing description of the preferred embodiments of the invention has been presented for purposes of illustration and description. It is not intended to be exhaustive or to limit the invention to the precise form disclosed, and obviously many modifications and variations are possible in light of the above teaching. For example, the head support of the present invention may be secured directly to the top of a user's head, without an intermediate hard hat, using a chin strap or the like. Of course, in such an embodiment, the housing would be modified as necessary to provide for a comfortable attachment to the head. Such modifications and variations that may be apparent to a person skilled in the art are intended to be included within the scope of this invention as defined by the accompanying claims.

I claim:

1. A rotatable, head mounted support apparatus for supporting a ceiling panel comprising:

a rotatable member including a first, upper rotatable plate for receiving said ceiling panel thereon, a turntable-type bearing, and a second, lower plate attachable to a top portion of a protective head covering, wherein said turntable-type bearing is located between and attached to said first, upper rotatable plate and said second, lower plate, and wherein said first, upper rotatable plate is adapted to rotate independently of said second, lower plate; and securing members for removably securing the second, lower plate of said rotatable member against the top portion of said protective head covering, wherein said second, lower plate includes a resilient, shock absorbing bottom surface.

2. The rotatable, head mounted support apparatus according to claim 1, wherein said resilient, shock absorbing bottom surface has an annular configuration.

3. A rotatable, head mounted support apparatus for supporting a ceiling panel comprising:

a rotatable member including a first, upper rotatable plate for receiving said ceiling panel thereon, a turntable-type bearing, and a second, lower plate attachable to a protective head covering, wherein said first, upper rotatable plate is adapted to rotate independently of said second, lower plate; and securing members for removably securing the second, lower plate of said rotatable member to said protective head covering, wherein said securing members include first and second laterally disposed elastic elements, each said elastic element adapted for independently securing one side of the second, lower plate of said rotatable member to a corresponding side of said protective head covering.

4. The rotatable, head mounted support apparatus according to claim 3, wherein the second, lower plate of said rotatable member includes a housing for slidably receiving said first and second elastic elements therethrough, and wherein said rotatable member is adapted to be adjustably positioned forwardly and backwardly along the top portion of said protective head covering by sliding the lower plate lengthwise along said elastic elements.

5. A rotatable, head mounted support apparatus for supporting a ceiling panel comprising:

a rotatable member including a first, upper rotatable plate for receiving said ceiling panel thereon, a turntable-type bearing, and a second, lower plate attachable to a wearer's head, wherein said first, upper rotatable plate is adapted to rotate independently of said second, lower plate; and securing members for removably securing the second, lower plate of said rotatable member to said wearer's head, wherein said second, lower plate includes a resilient, shock absorbing bottom surface.

6. The rotatable, head mounted support apparatus according to claim 5, wherein said resilient, shock absorbing bottom surface has an annular configuration.

* * * * *